US008430210B2

(12) United States Patent
Jacobs

(10) Patent No.: US 8,430,210 B2
(45) Date of Patent: Apr. 30, 2013

(54) SYSTEM HAVING MULTIPLE CABS IN AN ELEVATOR SHAFT

(75) Inventor: Justin Jacobs, Menlo Park, CA (US)

(73) Assignee: Smart Lifts, LLC, Menlo Park, CA (US)

( * ) Notice: Subject to any disclaimer, the term of this patent is extended or adjusted under 35 U.S.C. 154(b) by 0 days.

(21) Appl. No.: 13/009,701

(22) Filed: Jan. 19, 2011

(65) Prior Publication Data

US 2012/0193170 A1 Aug. 2, 2012

(51) Int. Cl.
*B66B 11/08* (2006.01)
*B66B 9/00* (2006.01)
*B66B 7/06* (2006.01)

(52) U.S. Cl.
USPC ..... 187/249; 187/257; 187/258; 187/266; 187/404

(58) Field of Classification Search ..... 187/249, 187/257, 404, 258, 266; 52/30; *B66B 11/04, B66B 11/08, 7/06, 9/00, 7/00*
See application file for complete search history.

(56) References Cited

U.S. PATENT DOCUMENTS

| | | | | |
|---|---|---|---|---|
| 1,837,643 | A * | 12/1931 | Anderson | 187/249 |
| 1,896,776 | A | 2/1933 | James | |
| 1,896,777 | A | 2/1933 | James | |
| 3,658,155 | A | 4/1972 | Salter | |
| 4,356,890 | A | 11/1982 | Smart | |
| 4,458,788 | A * | 7/1984 | LePore | 187/393 |
| H702 | H * | 11/1989 | Shively et al. | 187/405 |
| 5,419,414 | A | 5/1995 | Sakita | |
| 5,526,901 | A | 6/1996 | Salmon | |
| 5,663,538 | A * | 9/1997 | Sakita | 187/382 |
| 6,854,564 | B2 | 2/2005 | Reuter et al. | |
| 7,032,716 | B2 | 4/2006 | Meyle et al. | |
| 7,353,913 | B2 | 4/2008 | Hashiguchi | |
| 7,357,226 | B2 | 4/2008 | Sakita | |
| 7,461,721 | B2 | 12/2008 | Aulanko et al. | |
| 8,047,333 | B2 | 11/2011 | Finschi | |
| 8,052,124 | B2 | 11/2011 | Monzon et al. | |
| 8,052,820 | B2 | 11/2011 | O'Donnell et al. | |

(Continued)

FOREIGN PATENT DOCUMENTS

| | | | |
|---|---|---|---|
| EP | 1564177 | | 8/2005 |
| JP | 04089787 | A * | 3/1992 |

(Continued)

OTHER PUBLICATIONS

PCT International Search Report and Written Opinion, PCT Application No. PCT/US2011/063210, Apr. 20, 2012, nine pages.

*Primary Examiner* — William A Rivera
*Assistant Examiner* — Stefan Kruer
(74) *Attorney, Agent, or Firm* — Intellectual Property Law Group LLP

(57) ABSTRACT

An elevator system which utilizes four or more independently moving cabs in each elevator shaft. The lower cabs are connected to four spatially separated counterweights at four different counterweight connection points. The connection points are horizontally shifted on different cabs in order to prevent interference between cables, pulleys and counterweights. The top cab may be connected to one or two counterweights by connection points on the roof of the cab. The cabs are mounted on two tracks, each track on one side of the elevator shaft. The system includes a motor attached to each of the cabs by lift cables to facilitate the independent movement of all cabs. Existing buildings can be retrofit for compatibility with the present invention.

21 Claims, 10 Drawing Sheets

U.S. PATENT DOCUMENTS

| | | | |
|---|---|---|---|
| 8,083,033 | B2 | 12/2011 | Kallioniemi et al. |
| 8,087,497 | B2 | 1/2012 | Fargo |
| 8,091,687 | B2 | 1/2012 | Hamaji |
| 8,103,105 | B2 | 1/2012 | Kuroda et al. |
| 8,109,367 | B2 | 2/2012 | Ach |
| 8,113,319 | B2 | 2/2012 | Anttila et al. |
| 8,118,138 | B2 | 2/2012 | Aulanko et al. |
| 8,118,139 | B2 | 2/2012 | Chen |
| 8,123,002 | B2 | 2/2012 | Smith et al. |
| 8,123,020 | B2 | 2/2012 | Fang et al. |
| 8,127,893 | B2 | 3/2012 | Mustalahti et al. |
| 8,136,637 | B2 | 3/2012 | Coquerelle et al. |
| 8,141,684 | B2 | 3/2012 | Bjorni et al. |
| 8,141,685 | B2 | 3/2012 | Utsunomiya |
| 8,146,714 | B2 | 4/2012 | Blasko |
| 8,151,950 | B2 | 4/2012 | Fargo |
| 8,157,058 | B2 | 4/2012 | Ach |
| 8,162,109 | B2 | 4/2012 | Amano |
| 8,172,041 | B2 | 5/2012 | Kawasaki et al. |
| 8,177,032 | B2 | 5/2012 | Hashimoto |
| 8,177,036 | B2 | 5/2012 | Stanley et al. |
| D662,002 | S | 6/2012 | Lee et al. |
| 8,205,720 | B2 | 6/2012 | Barneman |
| 8,205,721 | B2 | 6/2012 | Korhonen et al. |
| 8,205,722 | B2 | 6/2012 | Suihkonen et al. |
| 8,210,320 | B2 | 7/2012 | Ach |
| 8,235,178 | B2 | 8/2012 | Kocher |
| 8,235,179 | B2 | 8/2012 | Valjus et al. |
| 8,235,180 | B2 | 8/2012 | Kattainen et al. |
| 8,235,199 | B2 | 8/2012 | Illedits et al. |
| 8,240,453 | B2 | 8/2012 | Miyaji |
| 8,251,186 | B2 | 8/2012 | Webster et al. |
| D667,745 | S | 9/2012 | Wu |
| 8,256,579 | B2 | 9/2012 | Jia |
| 8,256,852 | B2 | 9/2012 | Qiu |
| 8,261,885 | B2 | 9/2012 | Ketoviita et al. |
| 8,261,886 | B2 | 9/2012 | Kigawa et al. |
| 8,267,224 | B2 | 9/2012 | Gremaud et al. |
| 8,272,481 | B2 | 9/2012 | Tracey et al. |
| 8,272,482 | B2 | 9/2012 | Takahashi et al. |
| 8,276,715 | B2 | 10/2012 | Smith et al. |
| 8,286,778 | B2 | 10/2012 | Grobbel |
| 8,297,413 | B2 | 10/2012 | Kigawa et al. |
| D670,747 | S | 11/2012 | Stroud et al. |
| 8,307,952 | B2 | 11/2012 | Fargo et al. |
| 8,307,953 | B2 | 11/2012 | Ferreira |
| 2003/0000778 | A1 | 1/2003 | Smith et al. |
| 2005/0279584 | A1 | 12/2005 | Reuter et al. |
| 2007/0181374 | A1 | 8/2007 | Mueller |
| 2008/0142310 | A1 | 6/2008 | Kocher |
| 2008/0149426 | A1 | 6/2008 | Kocher |

FOREIGN PATENT DOCUMENTS

| | | | | |
|---|---|---|---|---|
| JP | 2000351556 | A | * | 12/2000 |
| JP | 3252575 | | | 2/2002 |
| JP | 2004256275 | A | * | 9/2004 |
| WO | WO2006113153 | | | 10/2006 |
| WO | WO2010061036 | A1 | | 6/2010 |

* cited by examiner

SYSTEM HAVING MULTIPLE CABS IN AN ELEVATOR SHAFT

FIELD OF INVENTION

The invention relates generally to a multi-cab elevator system having cabs which move independently of each other in an elevator shaft.

BACKGROUND

Reducing the number of elevator shafts used in a building has been attempted for years in order to increase the space available for profitable purposes. It is expected that the number of hoistways in some large buildings could be reduced by over 80%. For years, double deck cabs have been used in order to increase the passenger capacity of a hoistway, with each deck serving even or odd floors. However, double deck cabs can limit the freedom of travel provided to passengers. Some systems have used multiple one-way shafts with several cabs being transferred from one shaft to another in order to create a loop of travel. This has proven to be too costly due to complexity and increased energy usage.

Another way to accomplish this is by having multiple cabs in a single shaft. The number of cabs in an individual shaft has been limited to two or three cabs due to the auxiliary equipment used for operation of one cab interfering with another cab's operation. Placing counterweights for the various cabs that do not interfere with each other can be a significant problem as the number of cabs increases. Using one central counterweight or two counterweights on opposing corners of a cab can result in less than ideal balance of the cabs. In some instances, the space needed for the travel of counterweights can be reduced, but this may require cable storage outside of the existing footprint of the elevator shaft. This is a drawback, since a significant advantage of a multiple cab elevator system is reducing the footprint used.

Elevator systems capable of using multiple cabs are also usually incapable of operating in an existing elevator shaft without substantial modification. This can significantly increase the installation cost of such a system.

SUMMARY

The present invention is an elevator system which allows four or more cabs to operate independently in a single elevator shaft. The cables used for various systems are generally restricted to areas outside the pathway of the cabs to eliminate interference. In an embodiment, the top cab is connected to two counterweights, while the rest of the cabs are connected to four counterweights each. The connection points between the top cab and its counterweights are at the center of the top surface of the cab. The connection points between the lower cabs and the counterweights are located on either side (wall) of the cabs and horizontally shifted relative to one another in order to avoid interference between cables and provide unencumbered access to each of the counterweight channels and pulleys. As long as interference preventing the movement of any of the cabs is avoided, various numbers of cabs may be used, and various numbers of counterweights may be used for the top and lower cabs. The present invention does not require any storage of cables due to each counterweight having its own counterweight channel and traveling the length of the hoistway.

In an embodiment, the cabs use two tracks which are located on opposite sides of the elevator shaft for guidance and breaking functions. The use of center side tracks provides more even weight distribution than other arrangements, such as one track near each of the four corners of the cab. The use of two tracks also creates less friction between the tracks and cabs, which results in energy savings. Each cab connects to a specific lift cable on the rear or one side of the cab. Each lift cable can be connected to, for example, a motor pulley and floor pulley to allow controlled movement of each cab independently.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

DETAILED DESCRIPTION OF THE INVENTION

A preferred embodiment of the present invention is now described with reference to the figures where like reference numbers indicate identical or functionally similar elements. Also in the figures, the left most digit of each reference number corresponds to the figure in which the reference number is first used.

Reference in the specification to "one embodiment" or to "an embodiment" means that a particular feature, structure, or characteristic described in connection with the embodiments is included in at least one embodiment of the invention. The appearances of the phrase "in one embodiment" in various places in the specification are not necessarily all referring to the same embodiment.

In addition, the language used in the specification has been principally selected for readability and instructional purposes, and may not have been selected to delineate or circumscribe the inventive subject matter. Accordingly, the disclosure of the present invention is intended to be illustrative, but not limiting, of the scope of the invention, which is set forth in the claims.

Figure 1:
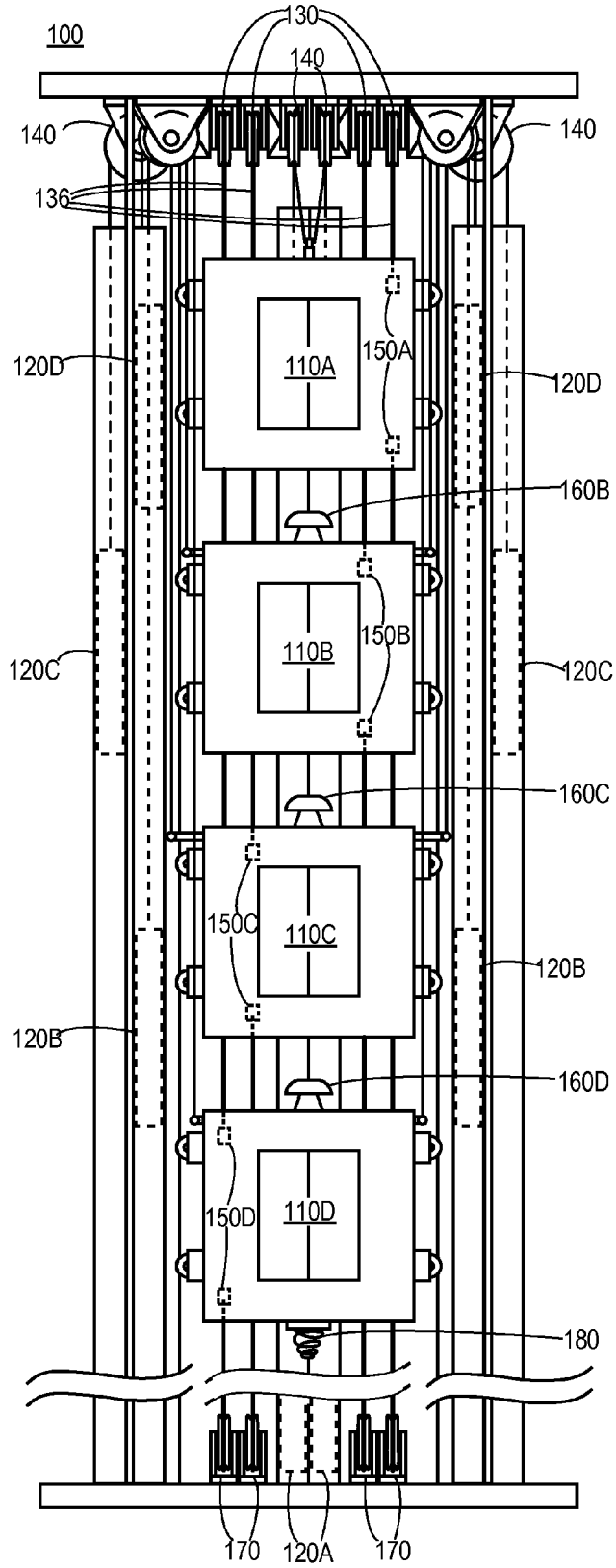
FIG. 1 is an illustration of the front providing an overview of an elevator system in accordance with one embodiment of the present invention.

A view from the front of a preferred embodiment of the multi-cab elevator system is illustrated in FIG. 1. A hoistway 100 is shown having four cabs 110. It should be recognized that the arrangement of the counterweight and motor systems allow for the operation of more than four cabs in other embodiments. Six, or more cabs can be operated in a single hoistway/shaft. This is made possible by the offset of counterweights and motors, as discussed below. The cabs 110 in the hoistway 100 are all aligned vertically. From top to bottom, the cabs are referred to as cab 1 (110A), cab 2 (110B), cab 3 (110C) and cab 4 (110D). Each of the cabs 110 is capable of moving throughout the hoistway 100 independently of one another, without passing another cab, due to each cab having an associated motor 130 and horizontally separated cables, pulleys 140 and counterweights 120.

The movement of the cabs 110 is driven by motors 130 positioned at the top of the hoistway 100, in the preferred embodiment. In alternate embodiments the motors 130 can be placed in different locations, such as the bottom of the hoistway or each motor can be placed at different locations. Each cab is connected to a motor 130 by a lift cable 136. Each lift cable 136 is attached to a cab 110 at two vertically aligned motor connection points 150 on the cab, e.g., on the rear face of the cab. Each cab can also have a single motor connection point 150 rather than the two illustrated. In this case, each end of a lift cable would attach to the same motor connection point. The motor connection points 150 of each cab are horizontally shifted to prevent interference (interaction) with another cables 136 from another cab 110. For example, in FIG. 1, the motor connections points 150 shift from right to left as the cabs 110 become lower in the hoistway 100. This allows a plurality of cabs beyond the four in this embodiment to each be controlled by a dedicated motor without any obstruction caused by the lift cables 136. One end of each of the lift cables 136 connects to the upper motor connection point 150 on a cab. The lift cables 136 are then routed through the motors 130 near the ceiling of the hoistway. The lift cables 136 are then routed through floor pulleys 170 which are attached to the bottom of the hoistway. Finally, the other end of each of the lift cables 136 is attached to the lower of the two motor connection points 150.

In an embodiment, counterweights 120 are located on the sides and rear of the cabs 110 and travel along the length of the hoistway 100. Each of the counterweights 120 is connected to a cab by a counterweight cable running through one of the counterweight pulleys 140 located at the top of the hoistway 100. The counterweight pulleys 140 along the sides of the hoistway are aligned, in an embodiment, coaxially. Different sized pulleys account for different spacing between the cabs 110 and counterweights 120. Alternatively, multiple pulleys can be used to vary the spacing between the cabs 110 and counterweights 120. The counterweights 120 are all kept in individual counterweight channels in order to control the movement of the counterweights 120 and to avoid interaction/interference between counterweights 120. For example, the counterweights 120 and pulleys 140 can be horizontally shifted in order to provide unencumbered access to each of these systems and avoid interference with other equipment.

The bottom cab, cab 4 (110D), has a spring 180 or another collision dampening device on the bottom of the cab as a safety precaution. In the event of a collision between the bottom of the hoistway 100 and cab 4 110D, the spring mitigates the damage from impact. With the possible exception of the top cab, cab 1 100A, all cabs 110 have a bumper 160 or another collision dampening safety device on the top of the cab. The bumpers 160 are similarly used as a safety precaution to lessen the impact of a collision between two of the cabs 110.

Figure 2:
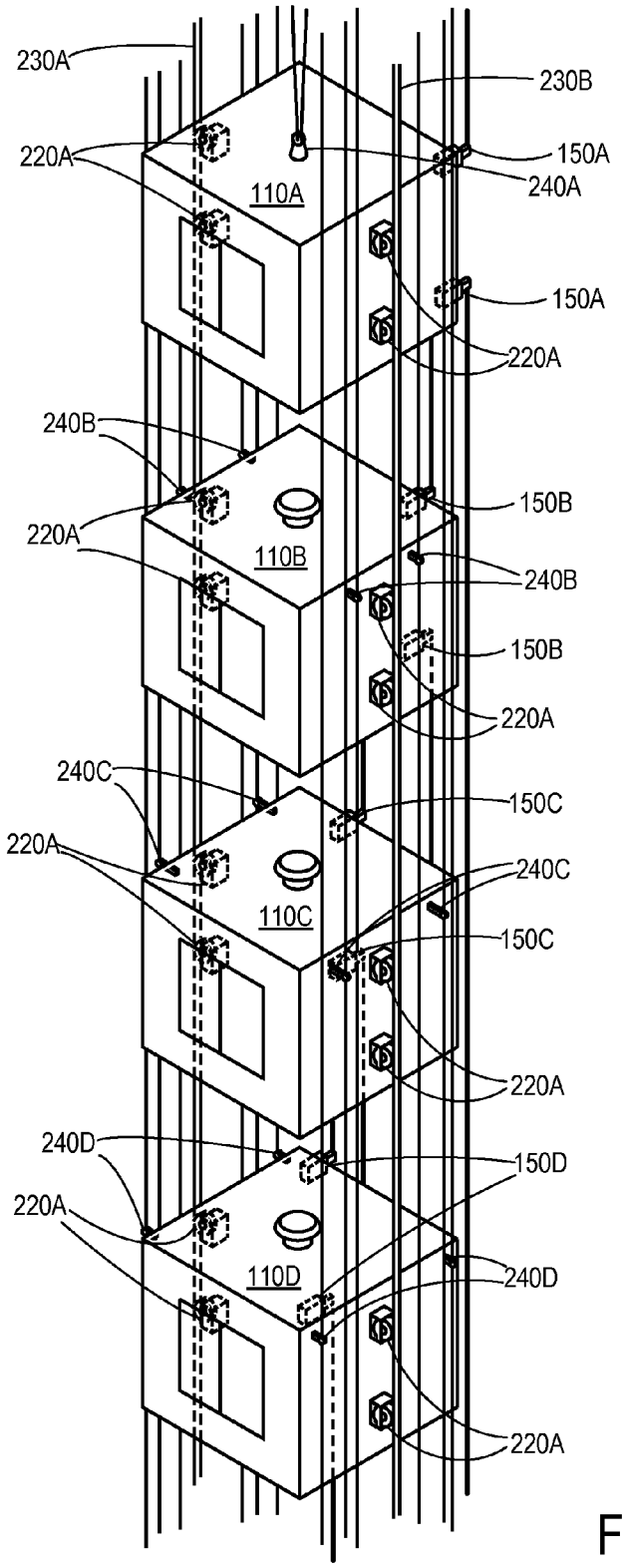
FIG. 2 is an illustration of the cabs in the hoistway from another perspective highlighting the connections of the counterweights, motors and track elements to the cabs, in accordance with one embodiment of the present invention.

FIG. 2 is another perspective of the elevator system in accordance with one embodiment of the present invention. The cabs 110 move along two tracks 230 on each side of the hoistway that run the length of the hoistway 100. The cabs 100 are attached to the tracks 230 using guides 220. While illustrated as wheels, the guides 220 may also be double pronged guides which can serve as brakes. A mix of different types of guides can also be used, with some providing guidance and others providing brakes and guidance. Each of the depicted cabs 110 has four guides 220, two on opposite sides of the cab. In a preferred embodiment, each of the cabs has two guides 220, one on opposite sides of the cab. Various numbers of guides can be used. Having two tracks, rather than one at each corner as in some conventional systems, provides better weight distribution, e.g., more balanced weight distribution, and lower maintenance costs in certain situations. The use of two tracks also causes less friction between the guides and tracks which results in more efficient operation of the elevator system. In an embodiment two of the guides are positioned substantially along a center axis or plane of a first wall of the cab 110A and two guides are positioned substantially along a center axis or plane of a second wall of the cab 110A, wherein in one embodiment the first and second walls of the cab 110 are substantially parallel. The uppermost cab, cab 1 (110A), is connected to two counterweights 120 at the rear of the hoistway 100. In an embodiment, only one counterweight 120 is connected to cab 1 (110A). These counterweights are attached to cab 1 (110A) at counterweight connection point 240A, which is located at the center of roof of cab 1 (110A). In alternate embodiments cab 1 (110A) is connected to a different number of counterweights, e.g., one, four etc. In alternate embodiments cab 1 (110A) has multiple connection points, for example, similar to those described below.

In one embodiment, the remaining cabs, e.g., cab 2 (110B), cab 3 (110C) and cab 4 (110D), are connected to four counterweights each, with two located on either side of the cab. It is shown that the counterweight connection points 240 on the cabs 110 are horizontally shifted in order to avoid interference with one another. For instance, the cab 3 connections points 240C are shifted toward the front and rear of the hoistway 100 relative to the cab 2 connection points 240B.

Figure 3A:
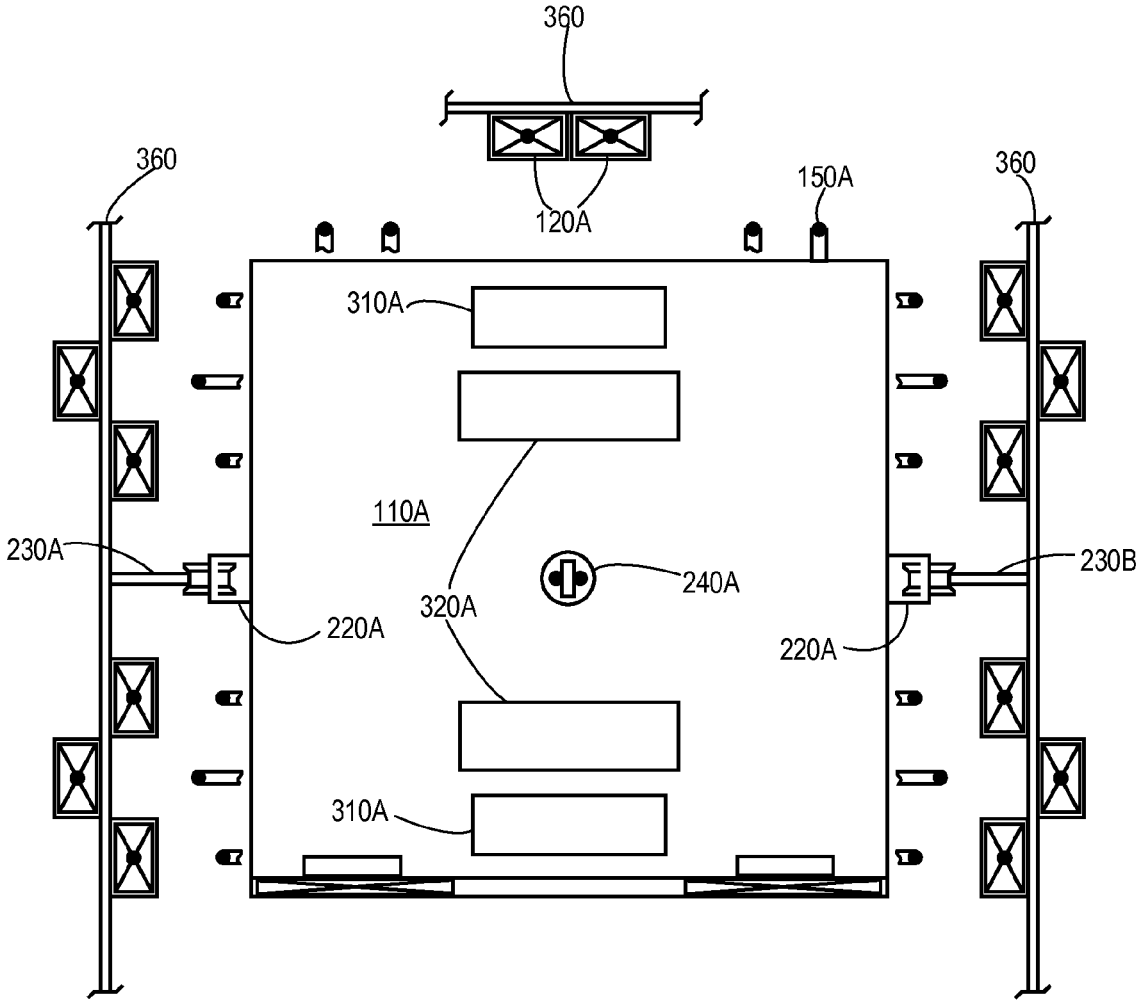
FIGS. 3A to 3D are illustrations of the top view of cabs 1, 2, 3 and 4 that show how each cab is connected to, among other things, the counterweights, vertical tracks, and motors, in accordance with one embodiment of the present invention.

FIGS. 3A, 3B, 3C, and 3D illustrate a top view of each of the cabs in one embodiment of the invention. As illustrated in FIG. 3A and as described above, the location of the cab 1 counterweights 120A is different than that of the other three cabs. The counterweight connection point 240A for cab 1 (110A) is located at the middle of the top of the cab rather than on the sides. The counterweight connection point is not implemented in this fashion on the other cabs since there is a cab above which would interfere with the counterweight connection cable. The counterweight connection point 240A is attached to the counterweights 120A at the rear of the hoistway. As illustrated, counterweights 120 can be attached to dividing walls 360. Dividing walls 360 allow counterweights and other equipment to be attached to both sides of the dividing wall 360. This increases the amount of counterweights and cabs that can fit in a single hoistway. The rear dividing wall can be extended to span the width of the rear of the hoistway. Counterweights can also be attached to the outer hoistway wall rather than a dividing wall, if dividing walls are not included. However, dividing walls allow significant flexibility in the selection and placement of counterweights. By using a dividing wall, a large number of counterweights can be included which allows many cabs to fit into a single hoistway. In some instances, these counterweights can be long and narrow in order to reduce the horizontal space occupied. Wells might be included at the bottom of the hoistway to provide long counterweights, and therefore cabs, full range of motion. The counterweights used by the cabs do not need to be of the same size or shape as long as the counterweights are kept evenly balanced for each of the cabs. In addition, a large number of counterweights, e.g., 16, can be used for a single cab as long as the counterweights for each cab are kept balanced.

Figure 3B:
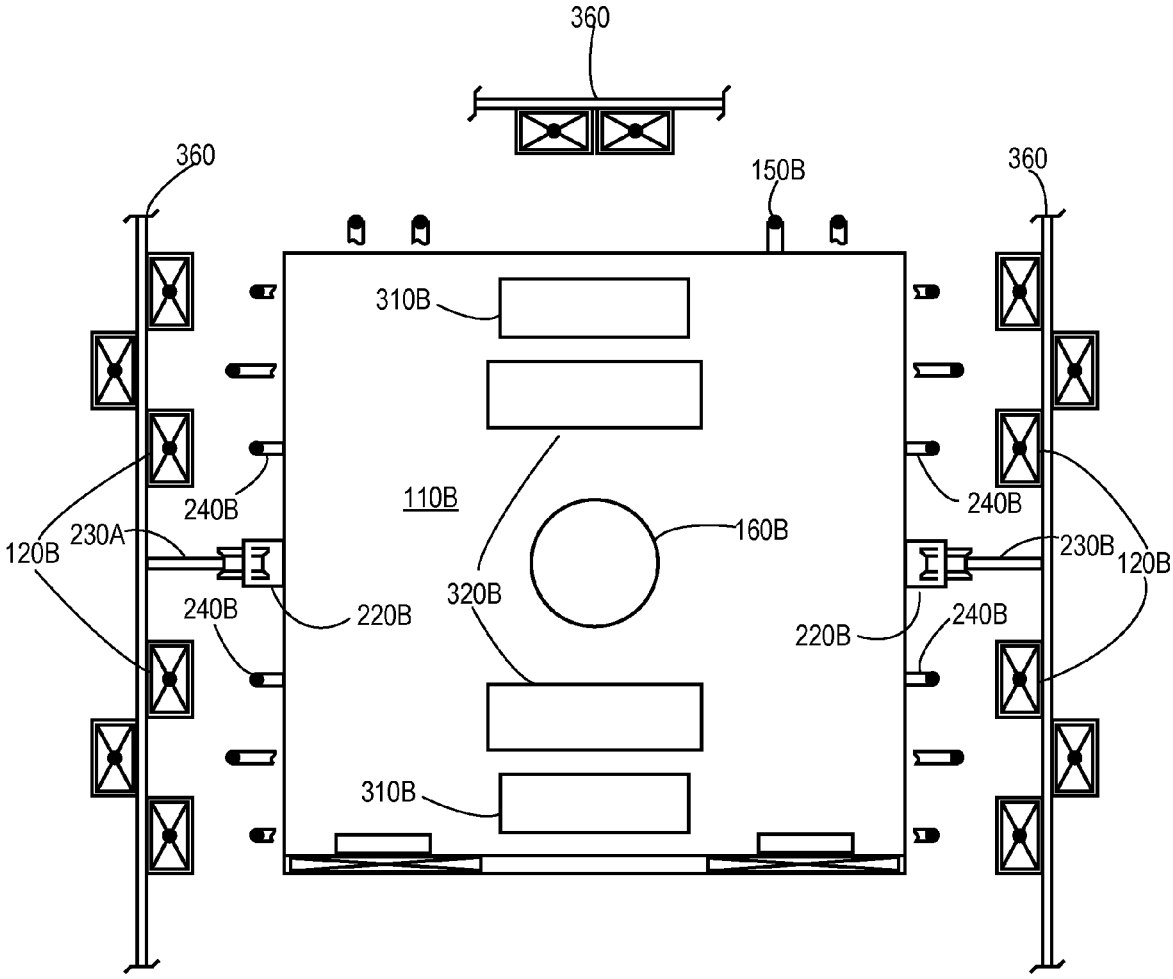
Figure 3C:
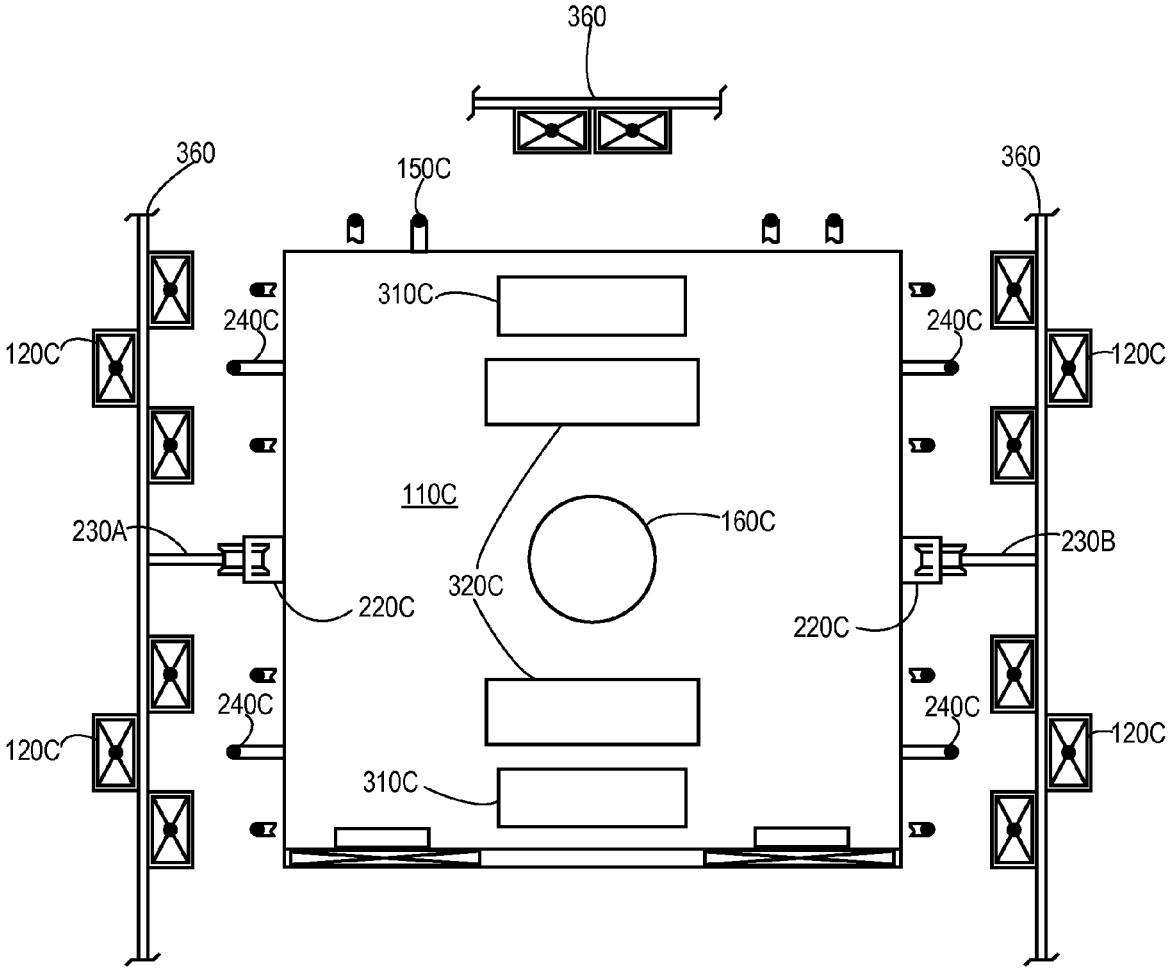
Figure 3D:
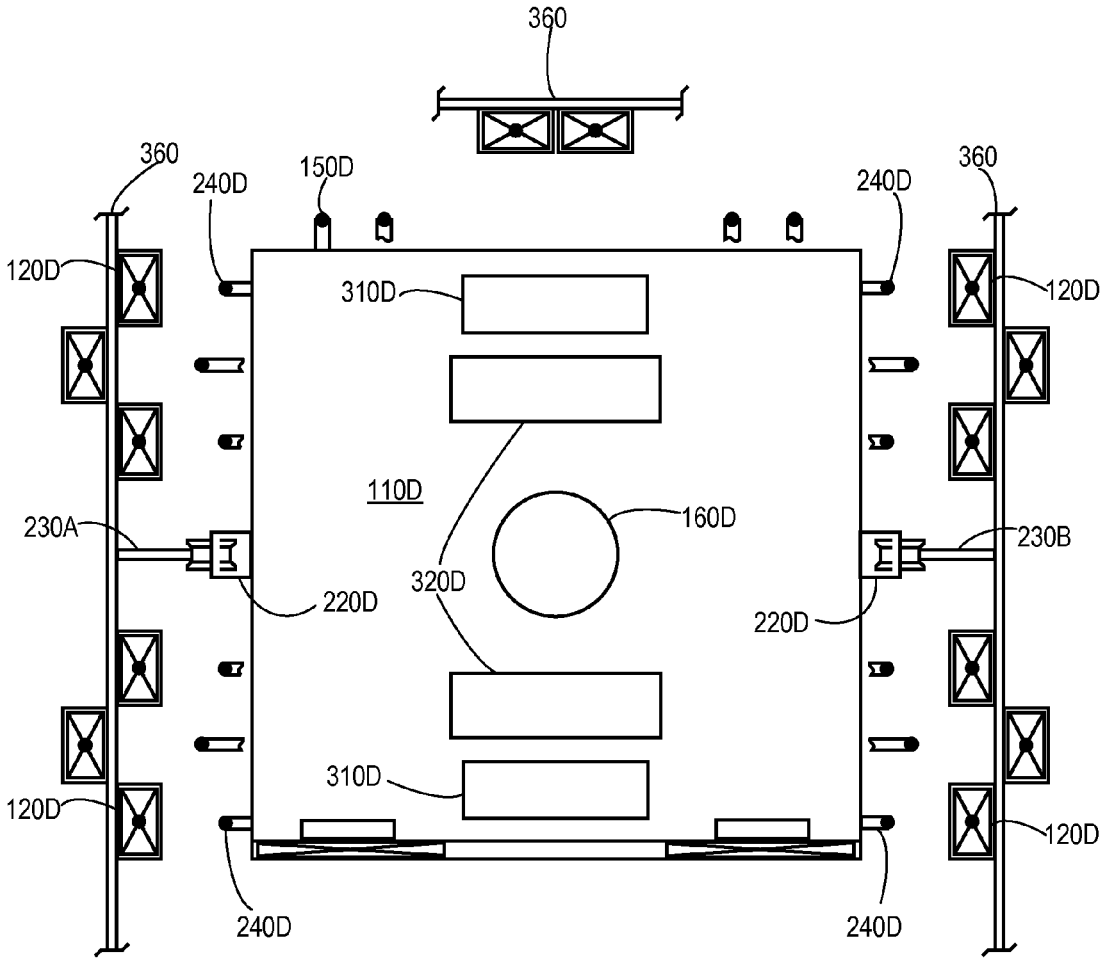

FIGS. 3B, 3C and 3D illustrate a top view of cabs 2, 3 and 4 respectively in accordance with one embodiment of the present invention. All of these cabs feature similar counterweight locations. Four counterweights 120 are placed horizontally near the sides of the cab, one in each quadrant of the cab. This arrangement, with four connection points to the counterweights, provides balance superior to conventional arrangements such as two counterweights in opposing corners. In one embodiment, in order to improve balance, the two counterweights 120 on each side of the cab are placed equidistant from the guides 220. As discussed above, the distance between the counterweights and the guides can be altered for each cab to prevent interference between counterweights, cables and pulleys. For example, the counterweight connection points 240B for cab 2 can be positioned so that an axis or plane formed between opposite connection points passes through or near the two-dimensional center of the cab 110B. That is, an imaginary axis or plane between counterweight connection point 240B in the upper left of FIG. 3B and counterweight connection point 240B in the lower right of FIG. 3B passes at or near the two-dimensional center of cab 110B (for example, near the center of bumper 160B in the two-dimensional perspective of FIG. 3B). Similarly an imaginary axis between counterweight connection point 240B in the upper right of FIG. 3B and counterweight connection point 240B in the lower left of FIG. 3B passes at or near the center of cab 110B. This assists in balancing the cabs and reducing the torque on the guides 220.

Similarly, the motor connection points 150 on the rear of each of the cabs are shifted on each cab in the hoistway to prevent interference between the motor systems and cables of each cab.

In one embodiment, as illustrated in FIG. 3B, the counterweights 120B of cab 2 110B are located nearest the tracks 230 on either side of the elevator shaft. Four counterweight connection points 240B are aligned with the counterweights and connected to the counterweights by a cable. A motor connection point 150B connects to a motor 130B towards the rear of the of elevator shaft to enable movement of the cab. The motor connection point 150B is horizontally shifted from motor connection points from other cabs to avoid interference with other cables. Two guides 220B are in line with the tracks 230 and direct the cab as it moves along the length of the elevator shaft.

In accordance with one embodiment and as illustrated in FIG. 3C, the counterweights 120C of cab 3 110C are located adjacent to the cab 2 counterweights 120B towards the outside of the hoistway. Four counterweight connection points 240C are aligned with the counterweights and connected to the counterweights by a cable. As discussed above, the distance between the counterweights and the guides can be altered for each cab to prevent interference between counterweights, cables and pulleys. For example, the counterweight connection points 240C for cab 3 can be positioned so that an axis or plane formed between opposite connection points passes through or near the two-dimensional center of the cab 110C. That is, an imaginary axis or plane between counterweight connection point 240C in the upper left of FIG. 3C and counterweight connection point 240C in the lower right of FIG. 3C passes at or near the two-dimensional center of cab 110C (for example, near the center of bumper 160C in the two-dimensional perspective of FIG. 3C). Similarly an imaginary axis between counterweight connection point 240C in the upper right of FIG. 3C and counterweight connection point 240C in the lower left of FIG. 3C passes at or near the center of cab 110C. As described above, this assists in balancing the cabs and reducing the torque on the guides 220.

A motor connection point 150C connects to a motor 130C towards the rear of the of elevator shaft to enable movement of the cab. The motor connection point 150C is horizontally shifted from motor connection points of other cabs to avoid interference with other motors and cables. Two guides 220C are in line with the tracks 230 and direct the cab as it moves along the length of the elevator shaft.

As illustrated in FIG. 3D, the counterweights 120D of cab 4 110D are located adjacent to the cab 3 counterweights 120C towards the outside of the hoistway. Four counterweight connection points 240D are aligned with the counterweights and connected to the counterweights by a cable. As discussed above, the distance between the counterweights and the guides can be altered for each cab to prevent interference between counterweights, cables and pulleys. For example, the counterweight connection points 240D for cab 4 are positioned so that an axis or plane formed between opposite connection points passes through or near the two-dimensional center of the cab 110D. That is, an imaginary axis or plane between counterweight connection point 240D in the upper left of FIG. 3D and counterweight connection point 240D in the lower right of FIG. 3D passes at or near the two-dimensional center of cab 110D (for example, near the center of bumper 160D in the two-dimensional perspective of FIG. 3D). Similarly an imaginary axis between counterweight connection point 240D in the upper right of FIG. 3D and counterweight connection point 240D in the lower left of FIG. 3D passes at or near the center of cab 110D. As describe above, this assists in balancing the cabs and reducing the torque on the guides 220.

A motor connection point 150D connects to a motor 130D near the rear of the of elevator shaft to enable movement of the cab. The motor connection point 150D is horizontally shifted from motor connection points of other cabs in order to avoid interference with other motors and cables. In addition, it should be noted that in another embodiment any of the cabs may be connected to multiple motors at multiple motor connection points. Two guides 220D are in line with the tracks 230 and direct the cab as it moves along the length of the elevator shaft.

Bumpers 160 on cabs 2, 3, and 4 are also illustrated in FIGS. 3B, 3C and 3D respectively. As described above, these bumpers mitigate the impact in a collision between two cabs. Electric sensors 310 and chain landings 320 are also depicted on the top of all of the cabs 110. The electric sensors provide information regarding cab location and can also provide information about the status of the cab, e.g., movement, direction, power status etc. The chain landings 320 can be used as an additional safety device, for example. While not illustrated, in an embodiment, horizontally shifted electric power and data cables originate at the vertical midpoint of each hoistway in order to minimize the distance to the cabs at any given time, and to prevent interference or storage of such cables. The data cables can also provide information to a central location and receiving information from a central location to assist in cab control, environmental control, etc.

Figure 4:
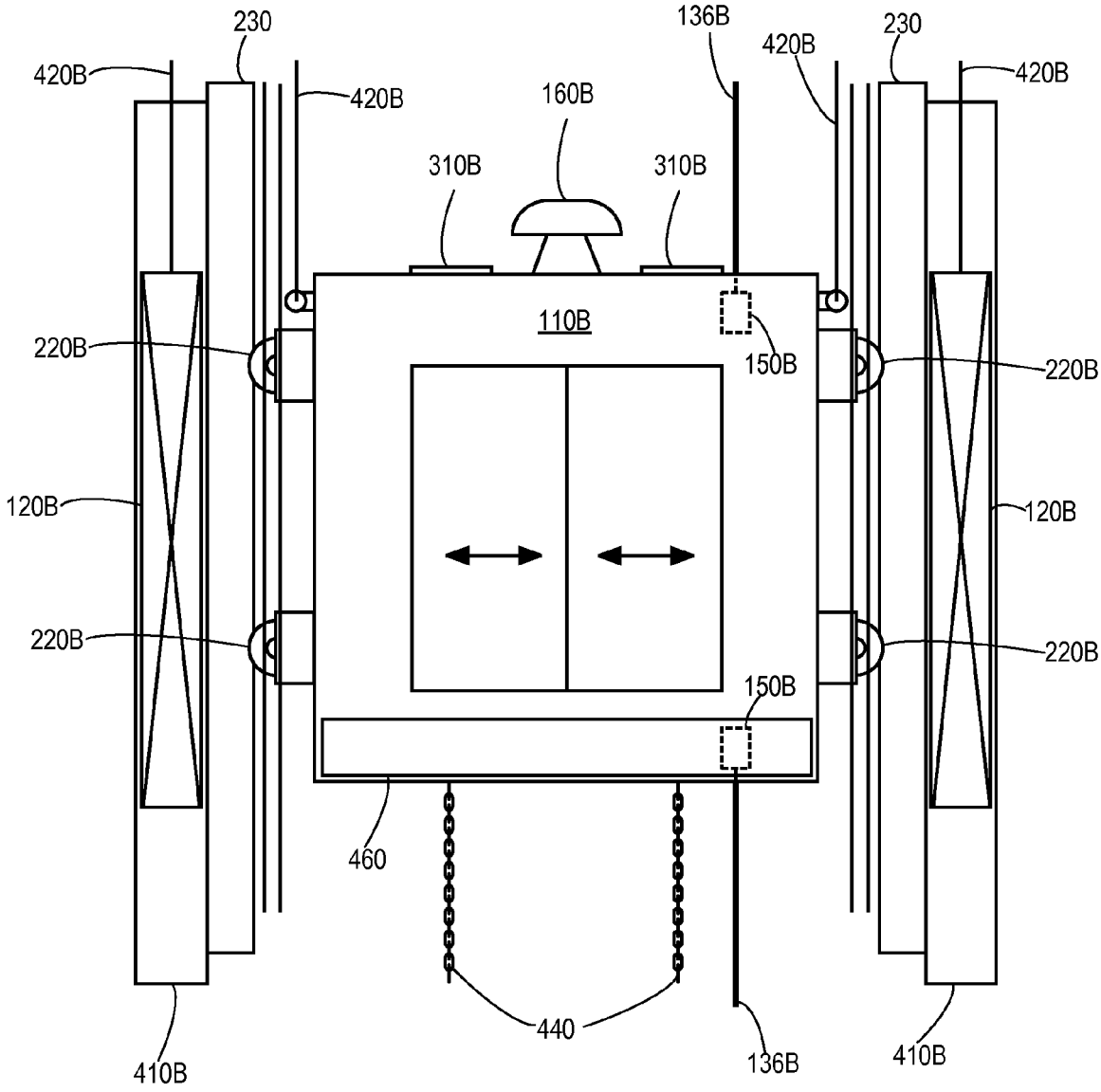
FIG. 4 is an illustration of a front view of cab 2 that shows how the counterweights and vertical tracks are attached to the cab in accordance with one embodiment of the present invention.

FIG. 4 illustrates a perspective from the front of cab 2 (110B). The tracks 230 are shown on either side of the cab. The two front counterweights 120B are also on either side of the cab. Two additional counterweights connected to cab 2 110B are behind the tracks 230B, but are not illustrated in FIG. 4. Each of the counterweights 120 in the system is guided by a channel which runs the length of the hoistway. As shown, the two counterweights 120B in FIG. 4 are contained in the channels 410B. The counterweights 120B are connected to the cab 110B by cab 2 counterweight cables 420B. The counterweight cables 420B are attached at the counterweight connection points 240B as discussed above. The lift cable 136B is shown to be attached to the cab 110B at two vertically aligned motor connection points 150B. In some embodiments, the control equipment 460 is located in the bottom portion of the cab. The control equipment 460 can also be located in the top or side portions of the cab. Among other things, the control equipment governs breaking, opening and closing of doors, leveling of a cab with building floors, and the movement of a cab, ensuring passengers reach their destination without incident. Sensor chains 440 are attached to the bottom of the cab in order to help detect the location of other cabs in the system. Similarly, electric and optical sensors 310B keep track of obstructions that may be located above the cab 110B and can assist in identifying the location of the cab 110B in the elevator shaft. A previously mentioned bumper 160B is located on top of the cab should a collision occur between cab 2 110B and another cab from above.

Figure 5:
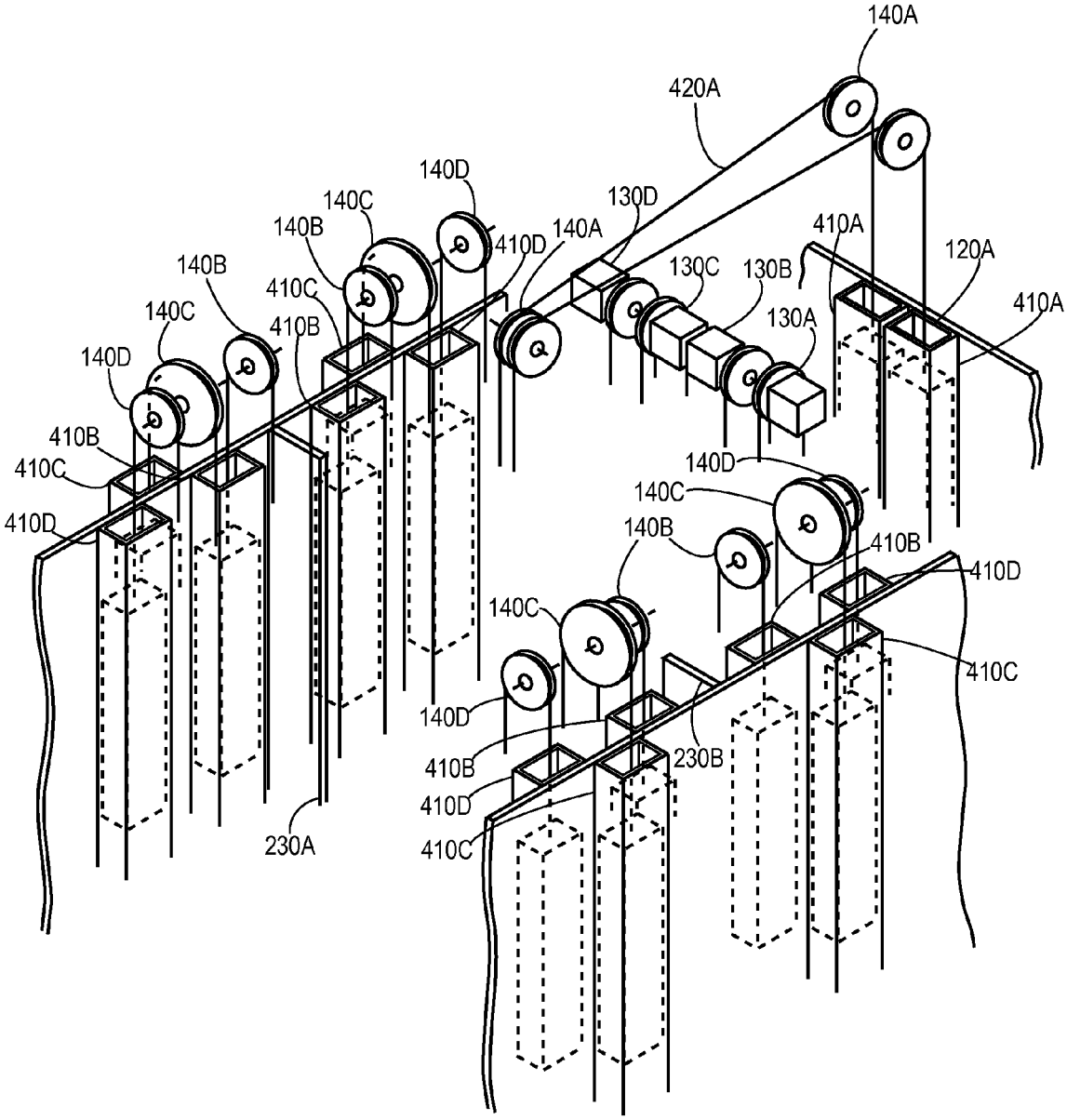
FIG. 5 is an illustration of the top of the elevator shaft that shows the placement of the counterweights in their channels in accordance with one embodiment of the present invention.

FIG. 5 illustrates the layout of the counterweights and counterweight channels, as well as the pulleys in accordance with one embodiment of the invention. The counterweight channels 410 and the cab 1 counterweights 120A are placed along the rear of the hoistway, in contrast to the placement of the other cabs' counterweights, in this embodiment. The cab 1 counterweights 120A are attached to cab 1 by counterweight cables 420A. Each of the counterweight cables runs through a pulley above the counterweight channel and a pulley above the center of cab 1 110A. The cab 1 counterweight channels are horizontally shifted from the motor assembly to prevent interference and allow unencumbered access to each i.e., the motor assembly 130 is between the cabs 110 and the cab 1 counterweights 120A. In the present embodiment, motor 130A is connected to cab 1 110A. This also preserves space and allows additional motors to be mounted for additional cabs. The placement of cab 1's counterweights at the rear of the hoistway is due to preference only. Other embodiments are possible which do not restrict counterweights to the disclosed locations. In alternate embodiments the position of counterweights 120A and counterweight channels 410A for cab 1 (110A) can vary, for example, they can be similar to the orientation set forth below with reference to cabs 2-4. This might be useful to allow doors on both the front and rear of the cabs.

In one embodiment, as shown in FIG. 5, the counterweight channels 410B of cab 2 110B are located near the tracks 230 on either side of the elevator shaft. In alternate embodiment the counterweight channels can be positioned elsewhere provided the channels, counterweights and related cables associated with the cabs do not interfere with each other. Pulleys 140B are located above the counterweight channels 410B and route the counterweight cables 420B from the counterweights 120B to the counterweight connection points 240B. Motor 130B, horizontally shifted from the other motors, is connected to the rear of cab 2 110B to enable movement of the cab.

The counterweight channels 410C of cab 3 110C are located adjacent to the counterweight channels 410B for cab 2 110B. Pulleys 140C are located above the counterweight channels 410C and route the counterweight cables 420C from the counterweights 120C to the counterweight connection points 240C. Motor 130C, horizontally shifted from the other motors, is connected to the rear of cab 3 110C to enable movement of the cab.

The counterweight channels 410D of cab 4 110D are located adjacent to the counterweight channels 410C for cab 3 110C and nearest the front and back of the elevator shaft. Pulleys 140D are located above the counterweight channels 410D and route the counterweight cables 420D from the counterweights 120D to the counterweight connection points 240D. Motor 130D, horizontally shifted from the other motors, is connected to the rear of cab 4 110D to enable movement of the cab.

The counterweight channels and counterweights for cabs 2, 3 and 4 can be stacked back-to-back on the sides of the hoistway. If preferred, the counterweights and their channels can be confined to the inside of the hoistway as well. While not shown in FIG. 5, adjacent counterweight channels placed back-to-back can overlap as long as the counterweights are offset so that pulley systems do not interfere with one another. This can increase the number of cabs that the system is able to operate when counterweight space is a limitation. The counterweight pulleys along either side of the hoistway can be coaxial and horizontally shifted in the same manner as the counterweights in order to allow the addition of more cabs. In an alternate embodiment, the counterweights and counterweight channels 410 are positioned external to the hoistway/shaft.

Figure 6:
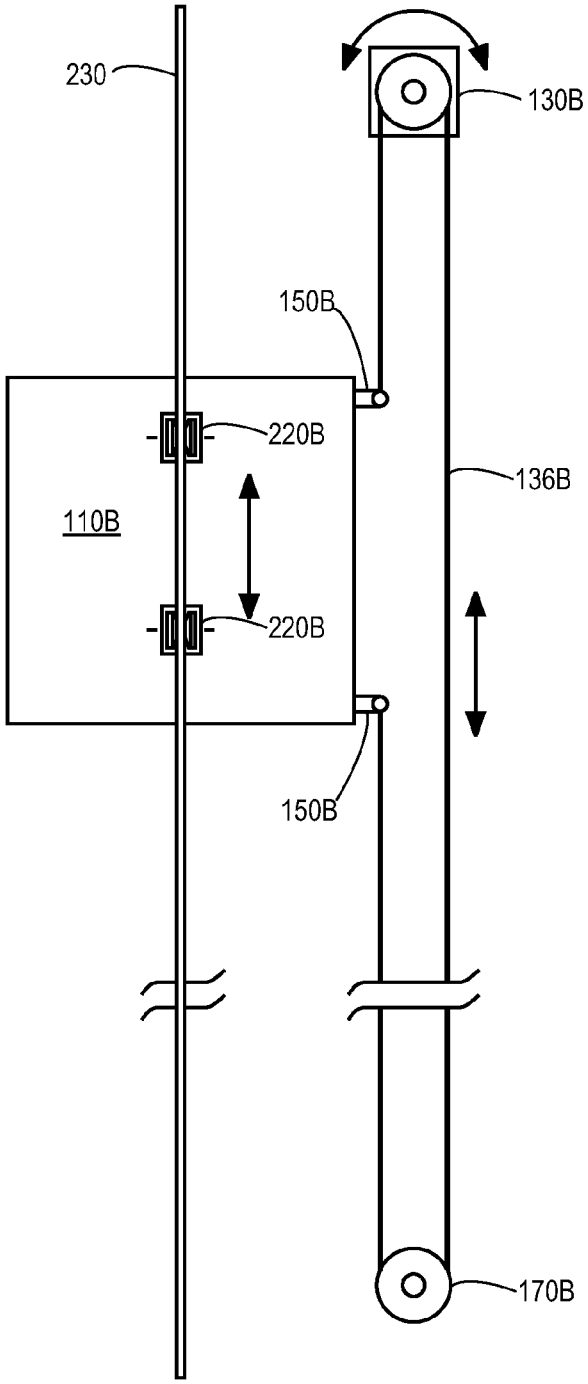
FIG. 6 is an illustration of the placement of the track and how the motor system is attached to each of the cabs in accordance with one embodiment of the present invention.

FIG. 6 illustrates a side view of the motor system used for each cab in accordance with one embodiment. In an embodiment, the motor illustrated here for cab 2 110B is similar for all cabs 110 although the particular positioning of the cables will vary. A vertical track 230 runs along each side of the hoistway and each track 230 connects to a cab at one or two guides 220B. The two guides 220B are attached to the track 230 and vertically aligned along the side of the cab 110B. Two motor connection points 150B are located on the back of the cab and vertically aligned. One end of a lift cable 136B is attached to the top motor connection point 150B. The lift cable 136B is then routed through the motor 130B, which is located near the top of the hoistway 100. The lift cable 136B then runs the length of the hoistway and is routed through the floor pulley 170B. Between the motor connection points 150B, the lift cable 136B is circular and continuous. Finally, the other end of the lift cable 136B is attached to the bottom motor connection point 150B. Like the counterweight system, this motor system eliminates the need for any cable storage.

While it is feasible in some embodiments for one hoistway to be used, e.g., in a deep mine shaft or a tall tower, two or more hoistways are used in the preferred embodiment for increased passenger convenience. With multiple hoistways, hoistways can alternate and coordinate the direction their cabs are traveling in effect creating a circular traffic pattern. Proper coordination of the directions cabs are traveling in can minimize the delay that passengers experience. The control system would ensure that enough cabs for service were traveling in each direction. Two hoistways with multiple cabs are expected to be sufficient for many buildings with 20 or more floors. In one embodiment, it is estimated that an additional hoistway is added for each additional 20 stories.

Figure 7:
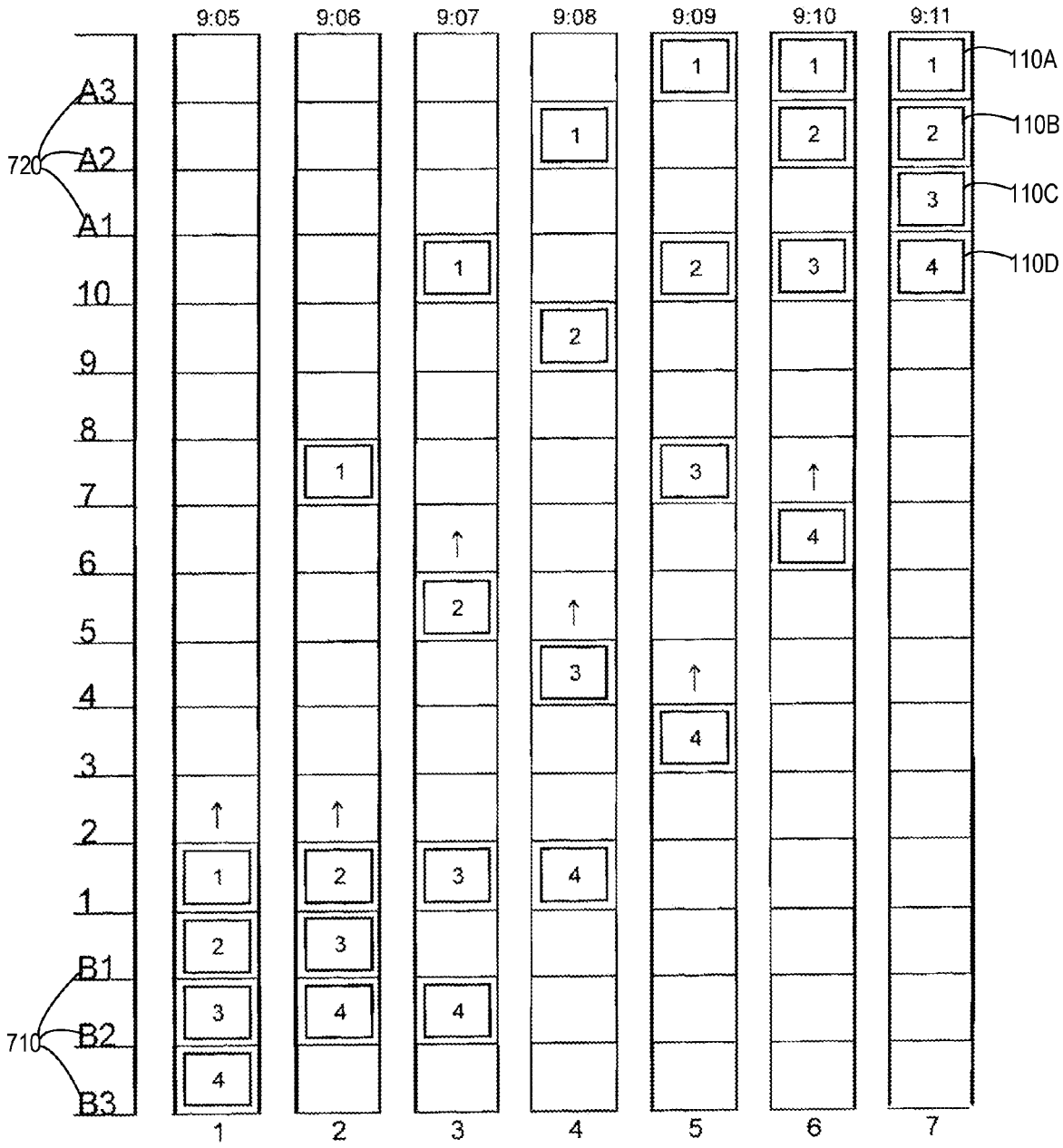
FIG. 7 is an illustration of the operation of an elevator shaft having multiple cabs in accordance with an embodiment of the present invention.

FIG. 7 illustrates the general operation of a hoistway with four cabs 110A-D. A hoistway is shown at 7 different points in time, 9:05 through 9:11, in order to demonstrate operation of the system. At 9:05, Cab 1 (110A) is located at floor 1 and the rest of the cabs are located at basement slots 710. The basement slots 710 may be on floors used for car parking. At 9:06, cab 1 (110A) moves up to transport passengers and the other cabs move up 1 level in order to prepare to transport passengers. At 9:07, cab 2 (110B) begins transporting passengers and cab 3 (110C) moves to floor 1 in preparation. At 9:08 cabs 2 and 3 are still transporting passengers and cab 4 has moved to floor 1 in preparation for transporting passengers. Cab 1 (110A) has moved to the attic or mechanical equipment slots 720 in order to allow the other cabs to service any of the floors in the hoistway. People transferring from parked cars on basement floors use cabs 2, 3 and 4 to arrive at their desired floors.

Attic 720 and basement 710 hoistway slots may be included to enable each cab to service all of the floors in the building, in this case, floors 1-10. For example, if attic hoistway slots A1-A3 were not present, only cab 1 (110A) would be able to service floor 10. Cab 1 (110A) would not be able to move out of the way and allow the other cabs to reach floor 10. The hoistway can still operate if the attic and basement slots are not included, but certain cabs would not be able to provide service to certain floors.

At 9:09, Cab 1 (110A) has moved to floor A3 in order to make room for cab 2 (110B) and cab 3(110C) in the attic slots. The cabs continue to travel upwards while transporting passengers and eventually moving to the highest floor possible. At this point, a similar process is begun in the opposite direction. In some situations, the cabs can reverse their direction of travel before all of the cabs have reached their highest or lowest point.

An advantage of this invention is that in addition to future buildings, many existing buildings can effectively and inexpensively be retrofitted for compatibility with the present invention. In an embodiment, the components can be contained within the existing hoistway and counterweights areas. In addition, the system may not need to store cables due to the arrangement of pulleys, counterweights and motors. In addition, some or most of the cables, pulleys, motors and other equipment can be located outside of the common hoistway, including above or below the hoistway. In an embodiment, by utilizing multiple cabs in a single shaft, a building can achieve additional elevator capacity while eliminating one or more shafts and converting those shafts to revenue producing space on each floor. The space used for elevator lobbies throughout a building can also be reduced by eliminating one or more shafts.

Modifications can be made to the system in order to allow opposing doors to be used on each of the cabs 110. For example, while not illustrated, all of the counterweights, motors and related equipment which would impede access to a rear door can be moved to the edges of the rear of the hoistway or cab or to the sides of the hoistway or cab alongside the lower cab counterweights. Similarly, counterweights, motors and related equipment can be placed on the front of the cab as long as they are towards the sides and do not affect use of the door. While useful for future buildings, the present invention is also compatible with existing buildings and elevator systems.

Each of the cabs moves independently due to each cab using separate counterweights and motors. In order to enable each cab to serve every floor of a building, cab storage levels may be included above and/or below the floors that are serviced. For example, in order for cab 1 (110A) to service the lowest serviced floor, there must be enough room under the lowest serviced floor for cabs 2 through 4 to be stored. Attic and basement hoistway slots could also be used to store cabs and suspend operation of certain cabs. This can help reduce operating costs during low usage periods such as nights, weekends and holidays in an office building. The system can also select a cab to serve only a certain subset of floors, which can help with high traffic sections of some large buildings, or with a certain number of floors dedicated to one company.

The above describes various embodiments relative to a building. It is envisioned that in alternate embodiments the invention can be utilized with a mine (underground), a tower, or integrated with horizontal movement systems.

While particular embodiments and applications of the present invention have been illustrated and described herein, it is to be understood that the invention is not limited to the precise construction and components disclosed herein and that various modifications, changes, and variations may be made in the arrangement, operation, and details of the methods and apparatuses of the present invention without departing from the spirit and scope of the invention as it is defined in the appended claims.

What is claimed is:

1. An elevator system comprising:

a first elevator shaft;

at least four elevator cabs positioned within said first elevator shaft, said four elevator cabs including a first elevator cab positioned above a second elevator cab, said second elevator cab positioned above a third elevator cab and said third elevator cab positioned above a fourth elevator cab, each of said four cabs having a first and second wall that are substantially parallel;

a first set of four cables coupled to said second elevator cab, two cables of said first set of four cables positioned on said first wall of said second elevator cab and the remaining two cables of said first set of four cables positioned on said second wall of said second elevator cab, wherein each of said four cables is connected to a respective counterweight in a first set of counterweights, wherein said respective counterweight is connected to only one cable of said first set of four cables;

a second set of four cables coupled to said third elevator cab, two cables of said second set of four cables positioned on said first wall of said third elevator cab and the remaining two cables of said second set of four cables positioned on said second wall of said third elevator cab, wherein each of said four cables is connected to a respective counterweight in a second set of counterweights, wherein said respective counterweight is connected to only one cable of said second set of four cables; each of said second set of four cables positioned such that the cables do not interfere with said first set of four cables connected to said second elevator cab; and a third set of four cables coupled to said fourth elevator cab, two cables of said third set of four cables positioned on said first wall of said fourth elevator cab and the remaining two cables of said third set of four cables positioned on said second wall of said fourth elevator cab, wherein each of said four cables is connected to a respective counterweight in a third set of counterweights, wherein said respective counterweight is connected to only one cable of said third set of four cables, each of said third set of four cables positioned such that the cables do not interfere with either said first set of four cables connected to said second elevator cab or said second set of four cables connected to said third elevator cab.

2. The elevator system of claim 1, wherein said elevator cabs further comprise:

a first guide, positioned on said first wall, for engaging a first vertical path in the elevator shaft; and a second guide, positioned on said second wall, for engaging a second vertical path in the elevator shaft.

3. The elevator system of claim 2, where said first guide is positioned substantially along a center axis of said first wall and said second guide is position substantially along a center axis of said second wall.

4. The elevator system of claim 1, wherein said first set of counterweights comprises four counterweights, each of said four counterweights of said first set of counterweights coupled to one of said cables in said first set of four cables.

5. The elevator system of claim 4, wherein said second set of counterweights comprises four counterweights, each of said four counterweights of said second set of counterweights coupled to one of said cables in said second set of four cables.

6. The elevator system of claim 5, wherein said third set of counterweights comprises four counterweights, each of said four counterweights of said third set of counterweights coupled to one of said cables in said third set of four cables.

7. The elevator system of claim 4, further comprising a set of four counterweight channels, each of said four counterweight channels for housing one of said first set of counterweights.

8. The elevator system of claim 7, wherein said set of four counterweight channels is attached to two or more dividing walls, a first subset of the set of four counterweight channels attached to a first dividing wall and a second subset of the set of four counterweight channels attached to a second dividing wall.

9. The elevator system of claim 1, further comprising a first set of counterweight channels, each counterweight channel of said first set of counterweight channels encloses one counterweight in said first set of counterweights.

10. The elevator system of claim 9, further comprising a second set of counterweight channels, each counterweight channel of said second set of counterweight channels encloses one counterweight in said second set of counterweights.

11. The elevator system of claim 10, further comprising a third set of counterweight channels, each counterweight channel of said third set of counterweight channels encloses one counterweight in said third set of counterweights.

12. The elevator system of claim 11, wherein said first, second and third set of counterweight channels are positioned such that the first set of counterweights do not interfere with the second or third set of counterweights during elevator operation.

13. The elevator system of claim 1 further comprising:

a first lift cable coupled to a first location of said second cab and a first motor, said first lift cable capable of moving said second cab in response to activation of said first motor.

14. The elevator system of claim 13, wherein said first lift cable is also coupled to a second location of said second cab, wherein during movement of the second cab, said first lift cable moves and no portion of said first lift cable is stored.

15. The elevator system of claim 13 further comprising:

a second lift cable coupled to a first location of said third cab and a second motor, said second lift cable capable of moving said third cab in response to activation of said second motor, wherein said second lift cables do not interfere with said first lift cables during operation.

16. The elevator system of claim 15, wherein said second lift cable is also coupled to a second location of said third cab, wherein during movement of the third cab, said second lift cable moves and no portion of said second lift cable is stored.

17. The elevator system of claim 15 further comprising:

a third lift cable coupled to a first location of said fourth cab and a third motor, said third lift cable capable of moving said fourth cab in response to activation of said third motor, wherein said third lift cables do not interfere with said first lift cables or said second lift cables during operation.

18. The elevator system of claim 17, wherein said third lift cable is also coupled to a second location of said fourth cab, wherein during movement of the fourth cab, said third lift cable moves and no portion of said third lift cable is stored.

19. The elevator system of claim 1, wherein a first axis is formed between one cable of said two cables of said first set of four cables positioned on said first wall and one cable of said two cables of said first set of four cables positioned on said second wall, and wherein said first axis passes substantially through a two-dimensional center of the second elevator cab.

20. The elevator system of claim 1, further comprising:

a first set of four pulleys, each pulley disposed to receive one cable of the first set of four cables;

a second set of four pulleys, each pulley disposed to receive one cable of the second set of four cables; and a third set of four pulleys, each pulley disposed to receive one cable of the third set of four cables.

21. The elevator system of claim 1, wherein said first set of counterweights are positioned external to the elevator shaft.

* * * * *